US008461524B2

(12) United States Patent
Dunyach et al.

(10) Patent No.: US 8,461,524 B2
(45) Date of Patent: Jun. 11, 2013

(54) ION GUIDE WITH IMPROVED GAS DYNAMICS AND COMBINED NOISE REDUCTION DEVICE

(75) Inventors: Jean Jacques Dunyach, San Jose, CA (US); August A. Specht, Fremont, CA (US); R. Paul Atherton, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 13/073,880

(22) Filed: Mar. 28, 2011

(65) Prior Publication Data

US 2012/0248304 A1 Oct. 4, 2012

(51) Int. Cl.
*H01J 49/44* (2006.01)
*H01J 49/26* (2006.01)

(52) U.S. Cl.
USPC ..... 250/294; 250/281; 250/396 R

(58) Field of Classification Search
USPC ..... 250/281, 282, 289, 294, 296, 396 R
See application file for complete search history.

(56) References Cited

U.S. PATENT DOCUMENTS

| | | | | |
|---|---|---|---|---|
| 3,859,226 | A * | 1/1975 | Schillalies | 250/282 |
| 5,637,879 | A * | 6/1997 | Schueler | 250/492.21 |
| 5,719,403 | A * | 2/1998 | Purser | 250/492.21 |
| 5,780,863 | A * | 7/1998 | Benveniste et al. | 250/492.21 |
| 6,396,057 | B1 * | 5/2002 | Jarrell et al. | 250/288 |
| 6,403,953 | B2 * | 6/2002 | Whitehouse et al. | 250/288 |
| 6,762,407 | B2 * | 7/2004 | Kalinitchenko | 250/294 |
| 6,891,157 | B2 * | 5/2005 | Bateman et al. | 250/292 |
| 7,952,070 | B2 * | 5/2011 | Senko et al. | 250/292 |
| 2003/0155496 | A1 * | 8/2003 | Kalinitchenko | 250/281 |
| 2003/0222214 | A1 * | 12/2003 | Baba et al. | 250/292 |
| 2004/0026614 | A1 * | 2/2004 | Bateman et al. | 250/281 |
| 2008/0058798 | A1 * | 3/2008 | Wallace et al. | 606/41 |
| 2009/0159796 | A1 * | 6/2009 | Belford et al. | 250/294 |
| 2009/0218486 | A1 * | 9/2009 | Whitehouse et al. | 250/288 |
| 2009/0266984 | A1 * | 10/2009 | Hirano | 250/288 |
| 2010/0301227 | A1 * | 12/2010 | Muntean | 250/396 R |
| 2012/0056110 | A1 * | 3/2012 | Distaso et al. | 250/492.21 |

FOREIGN PATENT DOCUMENTS

JP 2009/187771 A 8/2009

OTHER PUBLICATIONS

Michalski et al., "Ultra High Resolution Linear Ion Trap Orbitrap Mass Spectrometer (Orbitrap Elite) Facilitates Top Down LC MS/MS and Versatile Peptide Fragmentation Modes," Molecular & Cellular Proteomics, vol. 11 (3), 2012, pp. 1-11.

* cited by examiner

*Primary Examiner* — David A Vanore
*Assistant Examiner* — Wyatt Stoffa
(74) *Attorney, Agent, or Firm* — Pamela Lau Kee

(57) ABSTRACT

A mass spectrometry system arrangement includes a curved ion guide, where the curve of the ion guide is positioned such that a portion of the ion optics are visible from at the ion guide entrance, e.g. line of sight or z-axis. There are four electrodes parallel with each other and the central curved axis. Each electrode is equally radially spaced from the curved central axis. For each cross section of the ion guide, the central curved axis being positioned at the origin, the curved electrodes being radially positioned at 45°, 135°, 225°, and 315°. Depending upon the system, a blocking device is positioned external to the ion guide but within the "line of sight" or positioned tangential to the rising section of the bent ion guide.

19 Claims, 8 Drawing Sheets

ION GUIDE WITH IMPROVED GAS DYNAMICS AND COMBINED NOISE REDUCTION DEVICE

BACKGROUND

Mass spectrometry (MS) is an analytical technique that measures the mass-to-charge ratio of charged particles. It is used for determining masses of particles, for determining the elemental composition of a sample or molecule, and for elucidating the chemical structures of molecules, such as peptides and other chemical compounds. The MS principle consists of ionizing chemical compounds to generate charged molecules or molecule fragments and measurement of their mass-to-charge ratios.

In a typical MS procedure, a sample is loaded onto the MS instrument and undergoes vaporization. The components of the sample are ionized by one of a variety of methods (e.g., by impacting them with an electron beam), which results in the formation of charged particles (ions). The ions are separated according to their mass-to-charge ratio in a mass analyzer by electromagnetic fields. The ions are detected, usually by a quantitative method. The ion signal is processed into mass spectra.

FIG. 1 shows a block diagram of prior art MS instrument. The mass spectrometer comprises an ion source that generates and supplies ions to be analyzed to a set of ion optics including an ion guide are used to send the ions to the analyzer. Ion optics may be located adjacent to the ion guide so that mass spectra may be taken, under the direction of the controller. The mass spectrometer, as a whole, is operated under the direction of the controller. The mass spectrometer is generally located within a vacuum chamber provided with one or more pumps to evacuate its interior.

Ion storage devices that use RF fields for transporting or storing ions have become standard in mass spectrometers. One ion guide is the humpbacked ion guide, shown in FIG. 2 and FIG. 2B, is efficient in blocking neutrals/particles to prevent ion spikes due to debris. The elongate electrodes extend along a curved axis, the electrodes being paired in the x and y axes, e.g. 0°, 90°, 180°, and 270°. Unfortunately, there is accumulation of contaminants on rising section of the curved ion guide, e.g. the surface of electrode at 270° that tends to degrade the performance of the device over time. As the device does not allow for a good pumping out of the gas flow coming from the previous chamber, downstream optics, e.g. the ion optics can also become contaminated.

FIG. 3A and FIG. 3B shows an alternate arrangement of four electrodes in a curved ion guide device that confines and transfers ions using a combination of DC, RF, and AC fields. The elongate electrodes extend along a curved axis, the electrodes being paired in the x and y axes, e.g. 0°, 90°, 180°, and 270°. In addition to the ions, the ion optics are contaminated by additional debris, e.g. neutrals, particles, or charged droplets. The static charge from the debris builds up on the ion optics thereby degrading performance of the device over time.

SUMMARY

In one embodiment, a mass spectrometry system arrangement that includes a bent ion guide, where the bend of the ion guide is positioned such that a portion of the ion optics are visible from at the ion guide entrance, e.g. line of sight or longitudinal axis. There are four electrodes parallel with each other and the central curved axis. Each electrode is equally radially spaced from the curved central axis. For each cross section of the ion guide, the central curved axis being positioned at the origin, the curved electrodes being radially positioned at 45°, 135°, 225°, and 315°.

A removable blocking device is positioned external to the ion guide but within the "line of sight" of the ion optics.

The removable blocking device is a physical barrier large enough to collect the debris that could reenter the ion guide and accumulate on the ion optics or generate spikes.

In another embodiment, a mass spectrometry system that includes an alternate bent ion guide. The gas stream moves tangentially along a portion of the ion guide. The removable blocking device is positioned external to the ion guide.

BRIEF DESCRIPTION OF THE DRAWINGS

FIG. 2A illustrates a device view while

FIGS. 3A and 3B illustrate a curved ion guide used in the prior art. FIG. 3A illustrates a device view while

FIG. 5A illustrates a device view while FIG. 5B shows the cross-sectional view of the device.

FIG. 9A illustrates a device view while FIG. 9B shows the cross-sectional view of the device.

DETAILED DESCRIPTION

Figure 1:
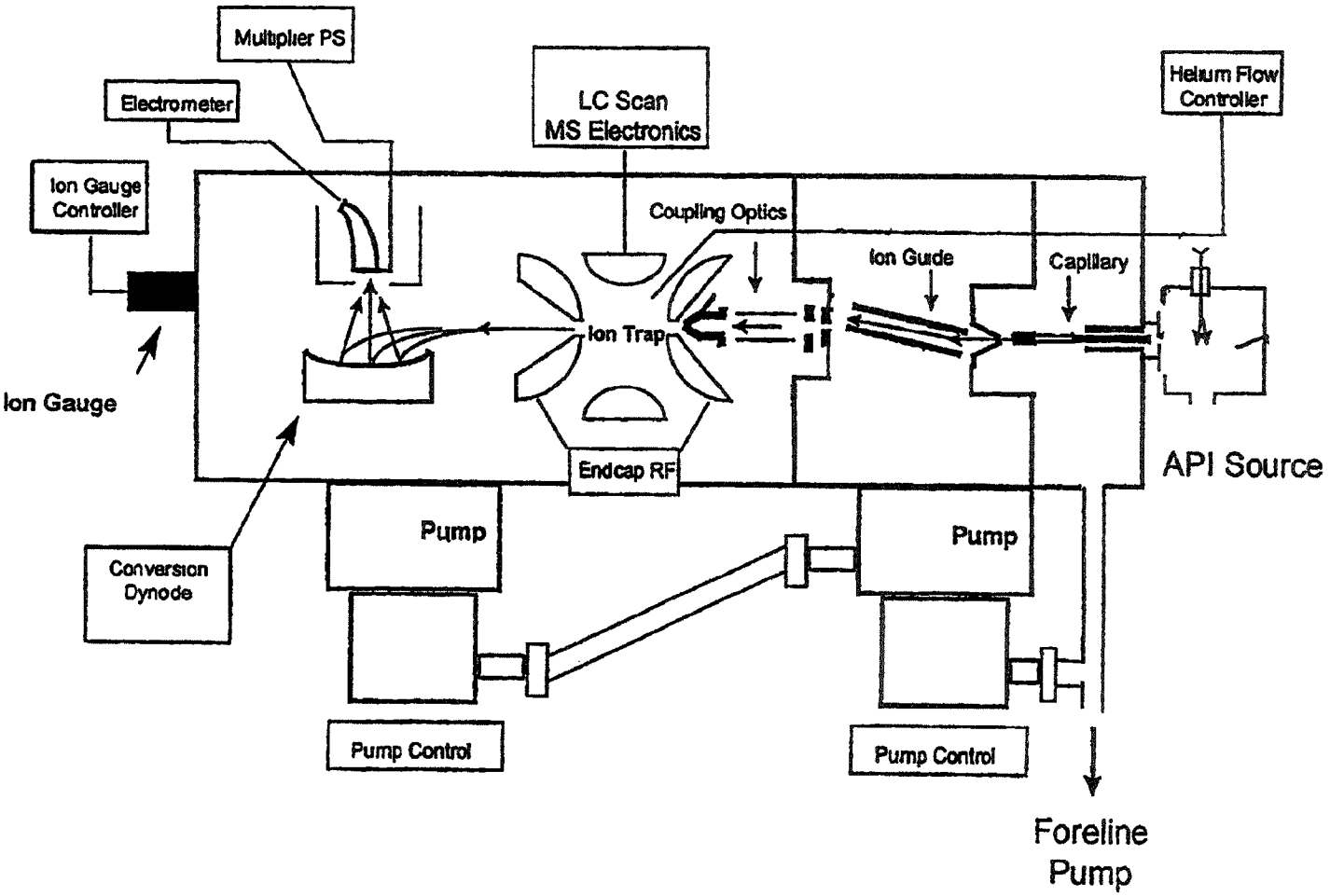
FIG.1 (PRIOR ART)
FIG. 1 illustrates a mass spectrometry system arrangement of the prior art.
Figure 2B:
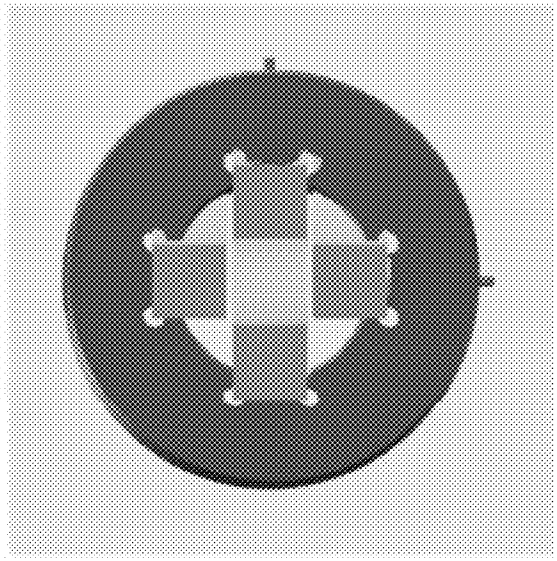
FIG. 2B (Prior Art)
FIG. 2A and FIG. 2B illustrate a humpback ion guide used in the prior art.
Figure 2A:
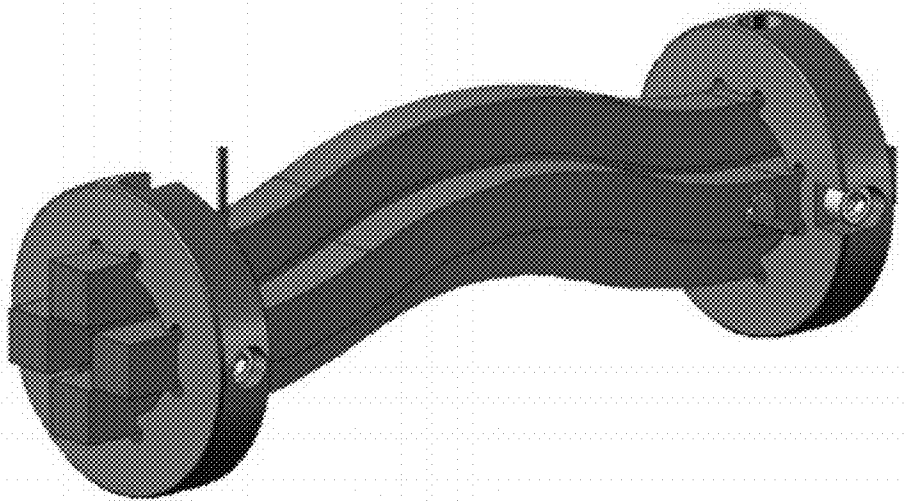
FIG. 2A (Prior Art)
Figure 3B:
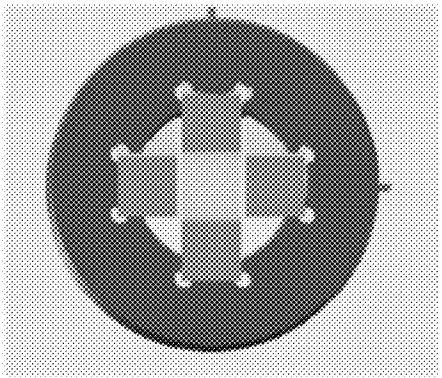
FIG. 3B (Prior Art)
FIG. 3B shows the cross-sectional view of the device.
Figure 3A:
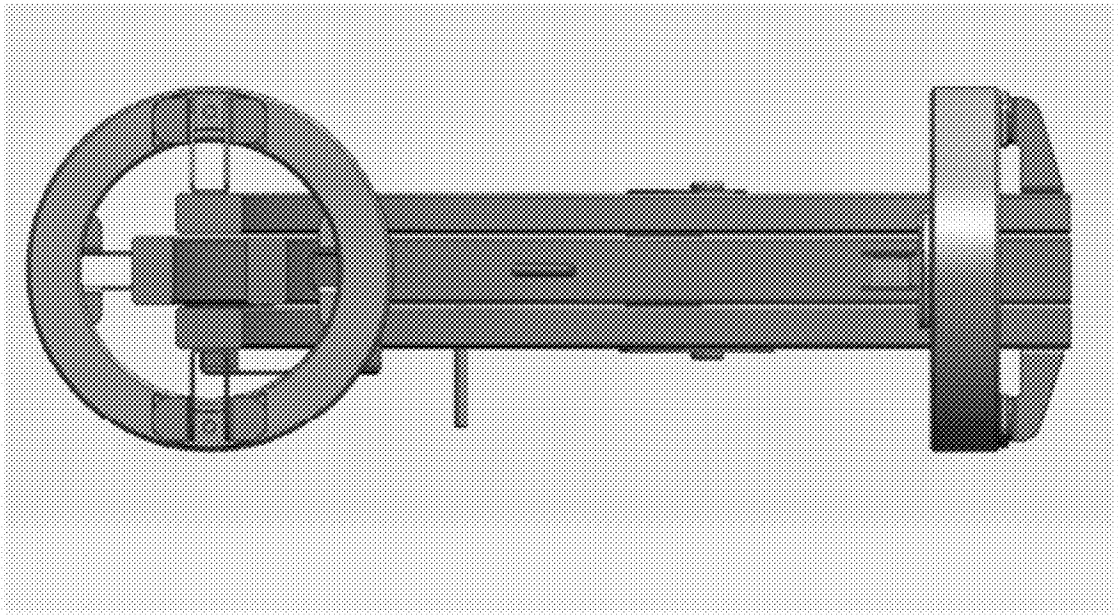
FIG. 3A (Prior Art)
Figure 4:
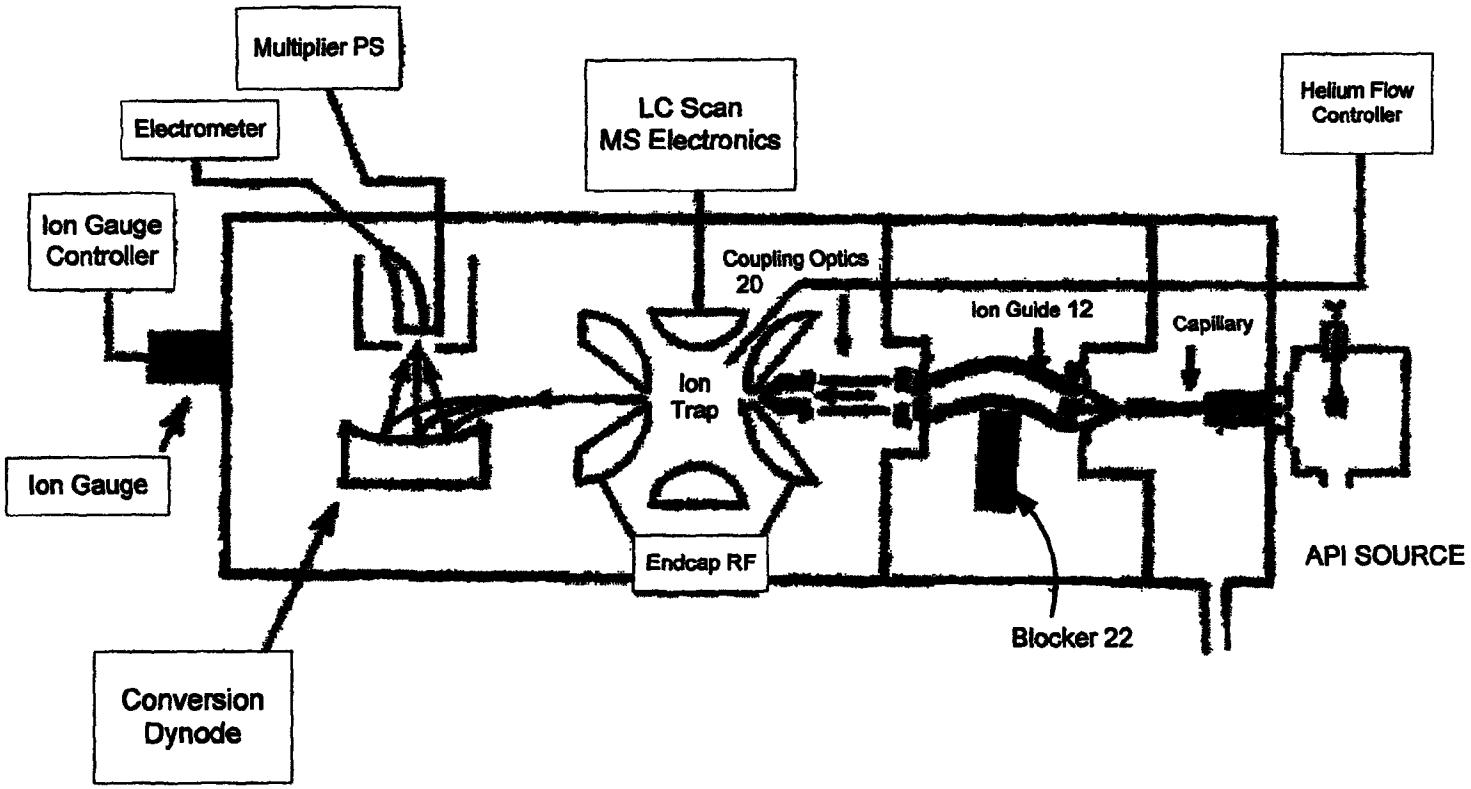
FIG. 4 illustrates an embodiment of the mass spectrometry system according to the invention.

FIG. 4 shows a block diagram of mass spectrometer of the present invention. An ion source that generates and supplies ions to be analyzed to a set of ion optics, including an ion guide. The ion guide is used to send the ions to the analyzer. Ion optics may be located adjacent to the ion guide so that mass spectra may be taken, under the direction of the controller (not shown). The mass spectrometer, as a whole, is operated under the direction of the controller. The mass spectrometer is generally located within a vacuum chamber (not shown) provided with one or more pumps to evacuate its interior.

The bend of the ion guide 12 is positioned such that the ion optics 20 are visible from the ion guide entrance, e.g. line of sight or z-axis, through the spaces between the electrodes of the ion guide 12. A removable blocking device 22 is positioned external to the ion guide 12 but along the "line of sight" of the ion optics 20.

Figure 5B:
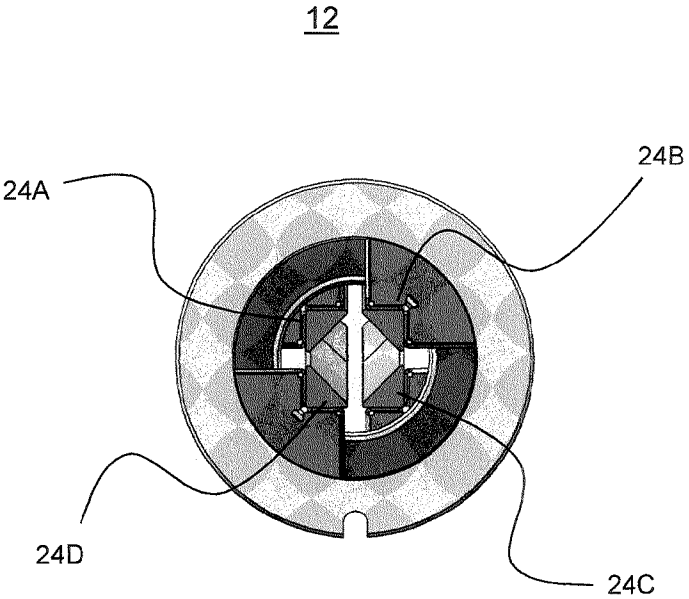
FIG. 5A and FIG. 5B illustrate a bent ion guide of the present invention.
Figure 5A:
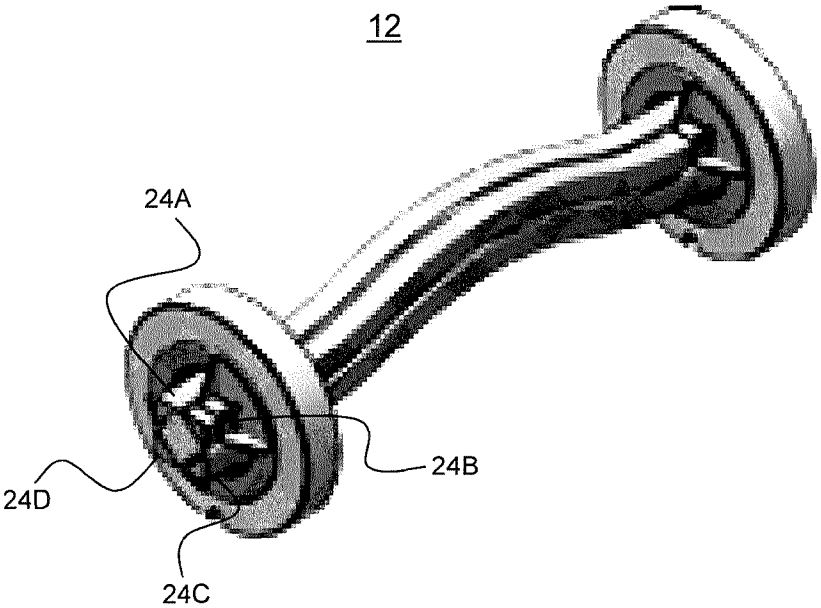

FIG. 5A and FIG. 5B illustrate a bent ion guide of the present invention. FIG. 5A shows the plan view while FIG. 5B illustrates a cross-sectional view. The ion guide includes N curved electrodes, where N 2. In this illustrative embodiment, N is 4.

The ion guide 12 includes 4 curved electrodes 24A-D. The ion guide 12 has a central curved axis being co-extensive with an arc of a circular section having a radius of curvature and the x-axis extending between the ion guide entrance and the ion guide exit. A portion of the z-axis is external to the ion guide 12. In operation, the particulate matter travels along the longitudinal axis.

As shown in FIG. 5B, the four electrodes are parallel with each other and the central curved axis. Each electrode is equally radially spaced from the curved central axis. For each cross section of the ion guide, the central curved axis being positioned at the origin, the curved electrodes being radially positioned at 45°, 135°, 225°, and 315°.

In the prior art, the plane including the curved central axis is coincident with the x-axis, the ion optics are blocked by the rising section of the ion guide. This rising section of the ion guide collects the neutrals, particulants, and charged droplets. This debris increases the build up to static charges that affects the speed of ion transmission. As the debris is enclosed within the ion guide, the debris travels and collects on the ion optics.

Figure 6A:
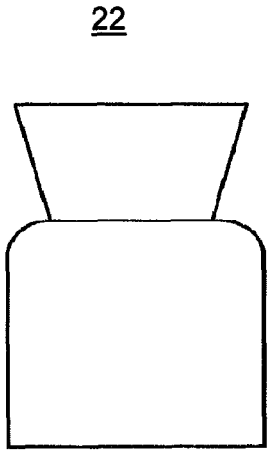
FIG. 6A-C illustrate embodiments of the removable blocking device shown in FIG. 6.
Figure 6B:
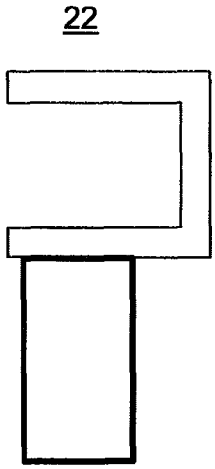
Figure 6C:
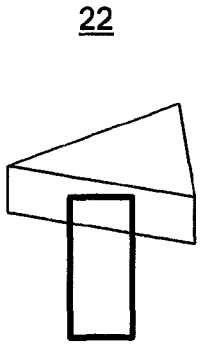

FIG. 6A-C illustrates an embodiment of the removable blocking device shown in FIG. 4. FIG. 6A shows a blocking device that includes a flat surface facing the ion source that prevents particles from bouncing back into the ion guide. The surface is positioned such that the normal is away from the ion guide. FIG. 6B shows a block device that includes a concave surface that "captures or collects" the particles. FIG. 6C shows a blocking device that includes a vertex that deflects particles and gas stream away from the ion guide. Each surface is positioned such that the particle stream moves tangential to the surface or has a normal away from the ion guide. The aforementioned concepts may be combined to create a blocking device that deflects and collects particles.

Figure 7:
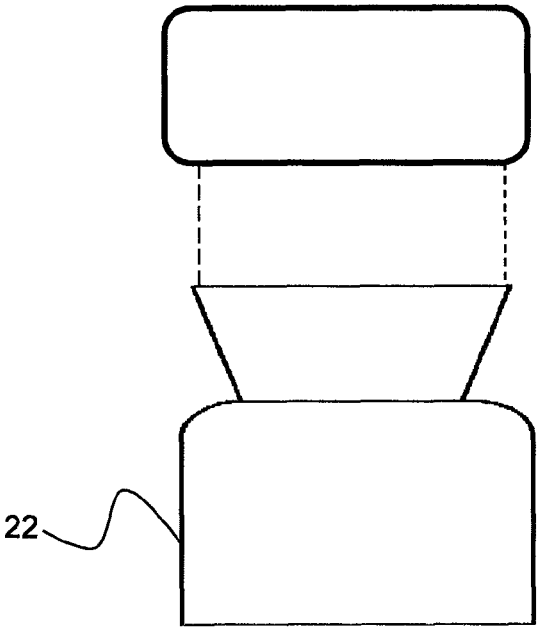
FIG. 7 illustrates an alternate embodiment of the removable blocking device shown in FIG. 6A-C.

The blocking device may be insulative or conductive. When the blocking device is conductive, the blocking device is a conductive metal post to allow grounding or being tied to a power supply. FIG. 7 further shows an optional cap positioned over the tip of the post to facilitate quick and efficient cleaning.

FIG. 7 illustrates an alternate embodiment of the removable blocking device shown in FIG. 4. In this embodiment, the blocking device is an optional cap sheathing the tip of the post. The sheath is a physical barrier that prohibits reentry of particulant matter and debris into the ion guide. The sheath may consist of tape, plastic, cardboard, etc.

For the embodiments shown in FIG. 6 and FIG. 7, the post is external to the ion guide while blocking a portion of the ion optics.

Figure 8:
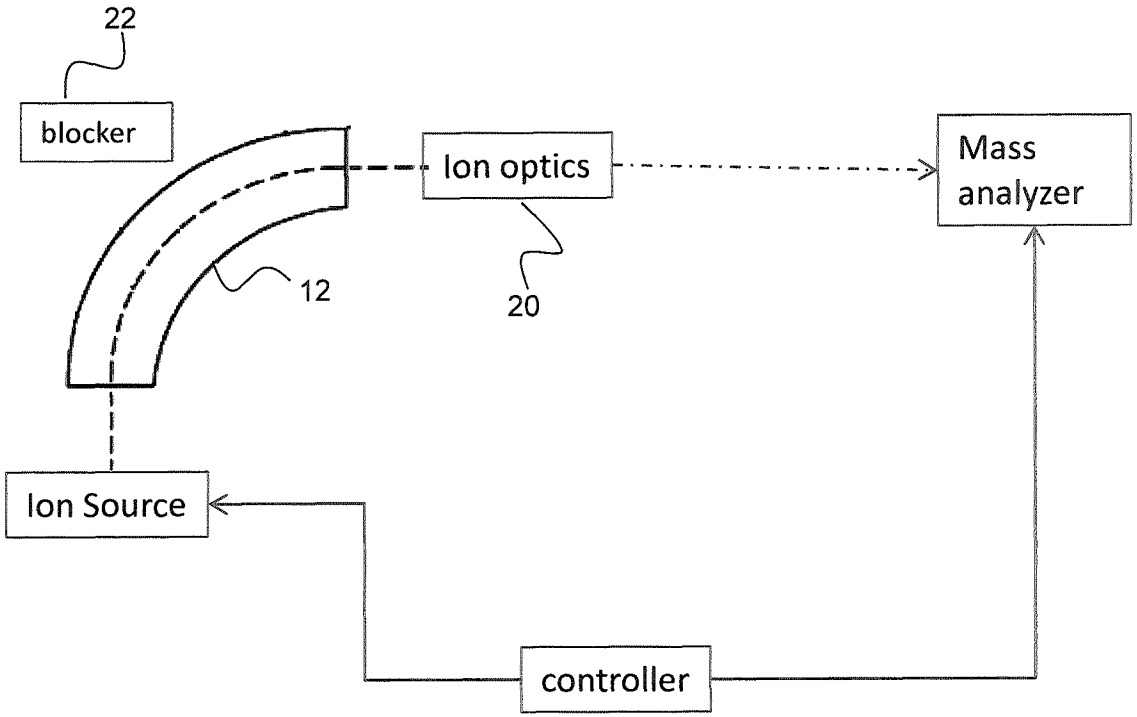
FIG. 8 illustrates another embodiment of the mass spectrometry system according to the invention.

FIG. 8 illustrates a mass spectrometry system that includes an alternate bent ion guide. The ion guide is positioned between the ion source and a mass analyzer. The mass analyzer is further connected to downstream analysis devices, e.g. detector optics. A removable blocking device is positioned external to the ion guide but within the "line of sight" along the z-axis.

Figure 9B:
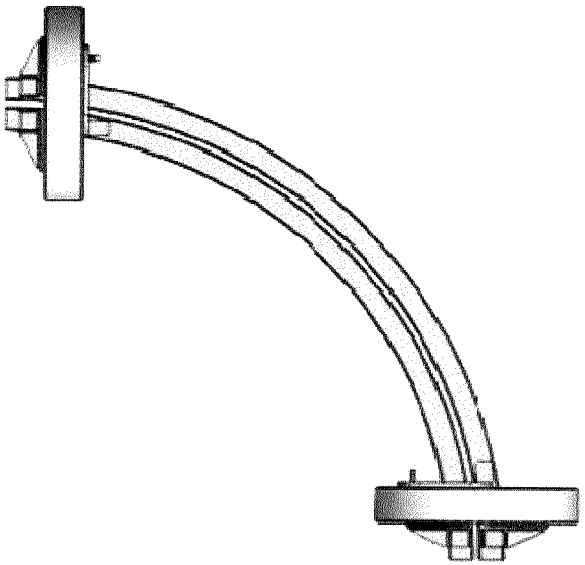
FIG. 9A and FIG. 9B illustrate a curved ion guide of the embodiment of FIG. 8.
Figure 9A:
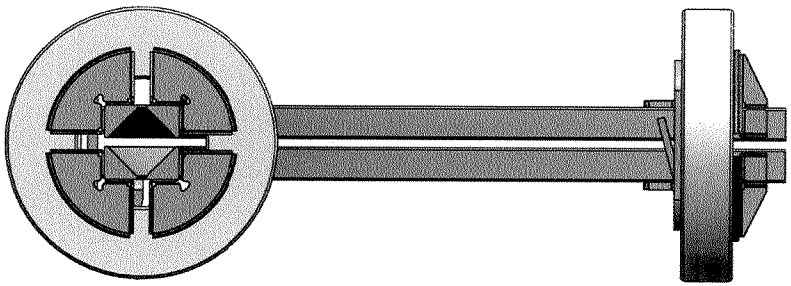

The "gas stream" travels tangential to the rising section of the curved axis. The ion optics are not exposed to the gas stream. FIG. 9A and FIG. 9B illustrates a curved ion guide 12 of the present invention. FIG. 9A shows the plan view while FIG. 9B illustrates a cross-sectional view. The ion guide 12 includes four curved electrodes 24A-D. The ion guide 12 has a central curved axis being co-extensive with an arc of a circular section having a radius of curvature and the z-axis extending between the ion guide entrance and the ion guide exit. A portion of the z-axis is external to the ion guide 12. In operation, the particulate matter travels along the z-axis.

As shown in FIG. 9B, the four electrodes 24A-D define a curved ion guide region arranged about the curved central axis and between the four electrodes. The curved ion guide region has a rising section and a falling section. The four electrodes are parallel with each other and the central curved axis. Each electrode is equally radially spaced from the curved central axis. For each cross section of the ion guide, the central curved axis being positioned at the origin, the curved electrodes being radially positioned at 45°, 135°, 225°, and 315°.

In the prior art, the plane including the curved central axis is coincident with the y-axis, the ion optics are blocked by the rising section of the ion guide. This rising section of the ion guide collects the neutrals, particulants, and charged droplets. This debris increases the build up to static charges that can affect the speed of ion transmission. As the debris is enclosed within the ion guide, the debris can also travel and collects on the ion optics.

In the present invention, the ion optics are not shielded by the rising section of the ion guide but shielded by the blocking device. In operation, the ions travel within the ion guide while the "gas stream" passes between the electrodes of the ion guide along the "line of sight" from the ion source to the ion optics. The debris exits the ion guide and collects on the blocking device before it can reenter the ion guide or is deflected by the blocking device.

While the ion guide has been illustratively described using curved electrodes, the concept can be extended to any ion guide, i.e. stacked ring ion guide, having an ion stream where particulate matter could reenter the ion guide and contaminate the ion optics.

We claim:

1. A mass spectrometry system comprising:

an ion source;

ion optics;

a mass analyzer positioned adjacent the ion optics;

an ion guide having N electrodes, where $N \geqq 2$ having a central curved axis representing an origin, wherein the radius to the center of the curve defines 0 degrees in a Cartesian coordinate system, the N electrodes being equally radially spaced from the central curved axis, interposing the ion source and the ion optics, positioned along a line of sight that is partially external to the ion guide from the ion source to the ion optics, wherein the electrodes are not visible; and an external blocker, interposing the entrance and exit of the ion guide, having a distal end interposing the line of sight to cover a portion of the mass analyzer.

2. The mass spectrometry system, as in claim 1, wherein:

N=4; and the ion guide has four electrodes, the four curved electrodes in parallel with each other and the central curved axis, the electrodes being equally radially spaced from the central curved axis.

3. The mass spectrometry system as in claim 2, wherein for each cross section of the ion guide, the central curved axis being positioned at the origin, the curved electrodes being radially positioned at 45°, 135°, 225°, and 315°.

4. The mass spectrometry system as in claim 1, the blocker positioned proximate a falling section of the ion guide.

5. The mass spectrometry system as in claim 1, wherein the blocker is insulative.

6. The mass spectrometry system as in claim 1, wherein the blocker is:

conductive; and electrically connected to one of GROUND and a power supply.

7. The mass spectrometry system as in claim 1, the blocker positioned proximate a rising section of the ion guide.

8. The mass spectrometry system as in claim 1, wherein the blocker is a rod.

9. The mass spectrometry system as in claim 1, the distal end including a surface facing the ion source and having a normal direction positioned away from the ion guide.

10. The mass spectrometry system as in claim 1, wherein the distal end of the blocker includes a concave surface facing the ion source.

11. The mass spectrometry system as in claim 1, wherein the distal end of the blocker has an angle facing the ion source, the angle interposing two surfaces.

12. The mass spectrometry system as in claim 1, further including a cap sheathing the distal end.

13. A mass spectrometry system comprising:

an ion source;

ion optics;

a mass analyzer positioned adjacent the ion optics; and within a chamber adjacent the mass analyzer, an ion guide having N electrodes, where $N \geqq 2$ having a central curved axis, interposing the ion source and the ion optics, and having a rising section positioned along a line of sight partially external to the ion guide from the ion source to the ion optics, wherein the electrodes are not visible, and an external blocker having a distal end, tangential to and positioned proximate to the rising section, positioned away from the line of sight.

14. A mass spectrometry system, as in claim 13, wherein: N=4; and the ion guide has four electrodes, the four curved electrodes in parallel with each other and the central curved axis representing an origin, wherein the radius to the center of the curve defines 0 degrees in a Cartesian coordinate system, the electrodes being equally radially spaced from the central curved axis.

15. The mass spectrometry system, as in claim 14, wherein for each cross section of the ion guide, the central curved axis being positioned at the origin, the curved electrodes being radially positioned at 45°, 135°, 225°, and 315°.

16. The mass spectrometry system as in claim 13, wherein the blocker is insulative.

17. The mass spectrometry system as in claim 13, wherein the blocker is:

conductive; and electrically connected to one of GROUND and a power supply.

18. The mass spectrometry system as in claim 13, wherein the distal end includes one of a surface, a concave surface, and an angle interposing two surfaces.

19. The mass spectrometry system as in claim 13, further including a cap sheathing the distal end of the blocker.

* * * * *